US005189853A

United States Patent [19]

Braine et al.

[11] Patent Number: 5,189,853

[45] Date of Patent: Mar. 2, 1993

[54] EDGE SEALING DEVICES FOR BUILDING STRUCTURES

[75] Inventors: Mark D. Braine; Ralph Kirby; Donald W. Schultz, all of Asheville; Richard G. Tuttle, Hendersonville; John B. Hickman, Asheville, all of N.C.

[73] Assignee: W. P. Hickman Company, Asheville, N.C.

[21] Appl. No.: 789,823

[22] Filed: Nov. 8, 1991

Related U.S. Application Data

[63] Continuation-in-part of Ser. No. 532,657, Jun. 4, 1990, abandoned.

[51] Int. Cl.[5] ..... E04B 7/00

[52] U.S. Cl. ..... 52/96; 52/58; 52/61; 52/219; 52/60

[58] Field of Search ..... 52/58, 60, 61, 62, 63, 52/95, 96, 219

[56] References Cited

U.S. PATENT DOCUMENTS

| | | | |
|---|---|---|---|
| Re. 26,056 | 7/1966 | Hickman . | |
| Re. 27,761 | 9/1973 | Attaway . | |
| Re. 28,870 | 6/1976 | Attaway et al. . | |
| 1,700,619 | 1/1929 | Young | 52/61 |
| 1,740,753 | 12/1929 | Vallas . | |
| 1,782,246 | 11/1930 | Schneider . | |
| 2,219,992 | 10/1940 | Hanson . | |
| 2,250,548 | 7/1941 | Ness . | |
| 2,734,602 | 2/1956 | Dawson . | |
| 2,995,870 | 8/1961 | O'Hanlon, Jr. | 52/62 |
| 3,012,376 | 12/1961 | Reddy et al. . | |
| 3,086,324 | 4/1963 | Cheney . | |
| 3,090,161 | 5/1963 | Edwards . | |
| 3,237,352 | 3/1966 | Edwards . | |
| 3,389,515 | 6/1968 | Hellebrand . | |
| 3,404,495 | 10/1968 | Simpson, Jr. . | |
| 3,444,658 | 5/1969 | Gobel . | |
| 3,447,273 | 6/1969 | Thom . | |
| 3,507,470 | 4/1970 | Gobel . | |
| 3,585,766 | 6/1971 | Jamieson . | |
| 3,608,255 | 9/1971 | Chomes . | |
| 3,624,973 | 12/1971 | Attaway . | |
| 3,668,811 | 6/1972 | Pollard . | |
| 3,680,269 | 8/1972 | Fischer, Jr. et al. . | |
| 3,766,694 | 10/1973 | Minialoff et al. . | |
| 3,802,140 | 4/1974 | Hickman . | |
| 3,815,302 | 6/1974 | Monroe . | |
| 3,979,860 | 9/1976 | Roth et al. | 52/60 |
| 4,037,372 | 7/1977 | Patry . | |
| 4,067,152 | 1/1978 | Wolma . | |
| 4,071,987 | 2/1978 | Hickman . | |
| 4,083,158 | 4/1978 | Wolma . | |
| 4,419,850 | 12/1983 | Butzen . | |
| 4,437,283 | 3/1984 | Benoit . | |
| 4,439,956 | 4/1984 | House . | |
| 4,543,758 | 10/1985 | Lane . | |
| 4,549,376 | 10/1985 | Hickman . | |
| 4,550,535 | 11/1985 | Drogosch . | |
| 4,592,176 | 6/1986 | van Herpen . | |
| 4,598,507 | 7/1986 | Hickman . | |
| 4,641,476 | 2/1987 | Webb et al. . | |
| 4,665,667 | 5/1987 | Taylor et al. . | |
| 4,707,961 | 11/1987 | Nunley et al. . | |
| 4,759,157 | 7/1988 | Webb et al. . | |
| 4,780,997 | 11/1988 | Taylor et al. . | |
| 4,780,999 | 11/1988 | Webb et al. . | |
| 4,858,406 | 8/1989 | Lane et al. . | |
| 4,964,248 | 10/1990 | Braine et al. . | |

FOREIGN PATENT DOCUMENTS

| | | |
|---|---|---|
| 603078 | 8/1960 | Canada . |
| 2306388 | 9/1973 | Fed. Rep. of Germany . |

OTHER PUBLICATIONS

Braas, Technique & Detail (Jan. 1981).

New "Low-Pro" Snap-Lok; MM Systems Corporation (1 p.).

Anchor-Tite—Fascia Standard; Metal Era (1 page).

Anchor-Tite—Installation Procedure; Metal Era (2 pages).

*Primary Examiner*—Richard E. Chilcot, Jr.

*Assistant Examiner*—Kien Nguyen

*Attorney, Agent, or Firm*—Harness, Dickey & Pierce

[57] ABSTRACT

An assembly is provided for sealing and capping an edge construction on a building structure wherein a facing, composed of masonry or other materials, is placed along a back wall, generally in a face-to-face relationship. The edge sealing or coping assembly seals and caps the interface and joint or space between the facing and the back wall and accommodates variances in the facing depth and/or the spacing between the facing and the back wall along the perimeter of the building.

23 Claims, 9 Drawing Sheets

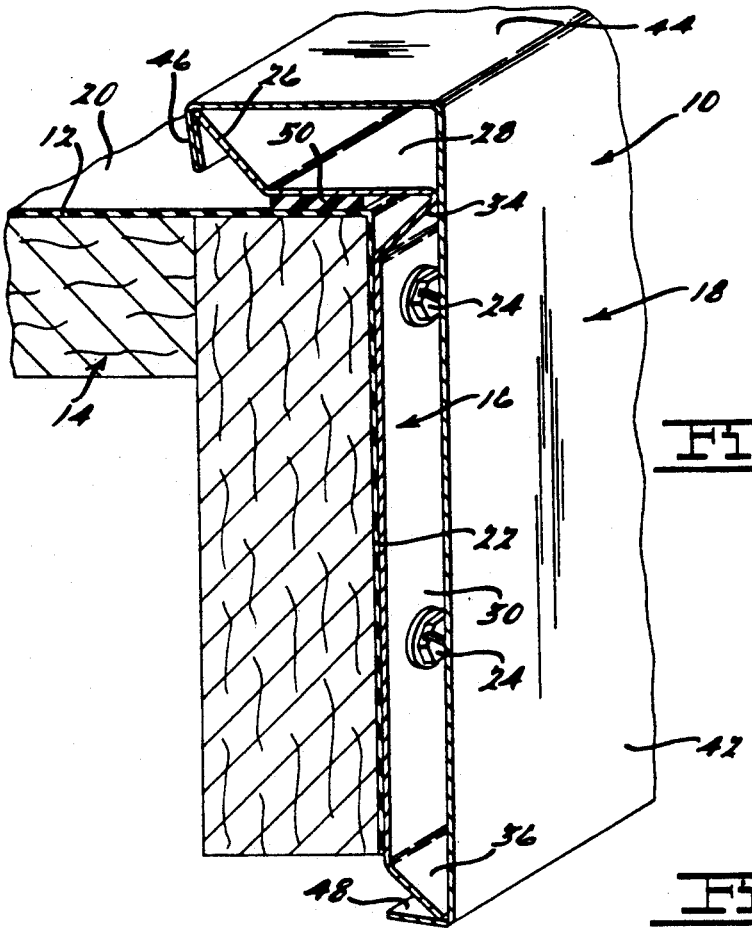
FIG. 1.
FIG. 2.
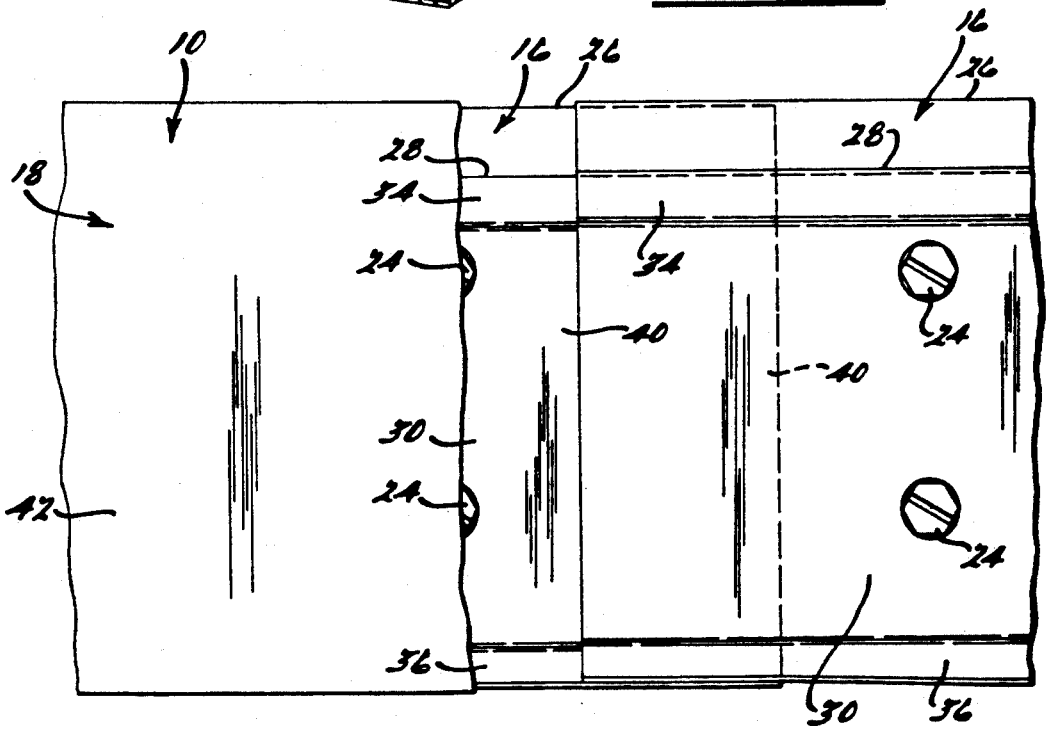

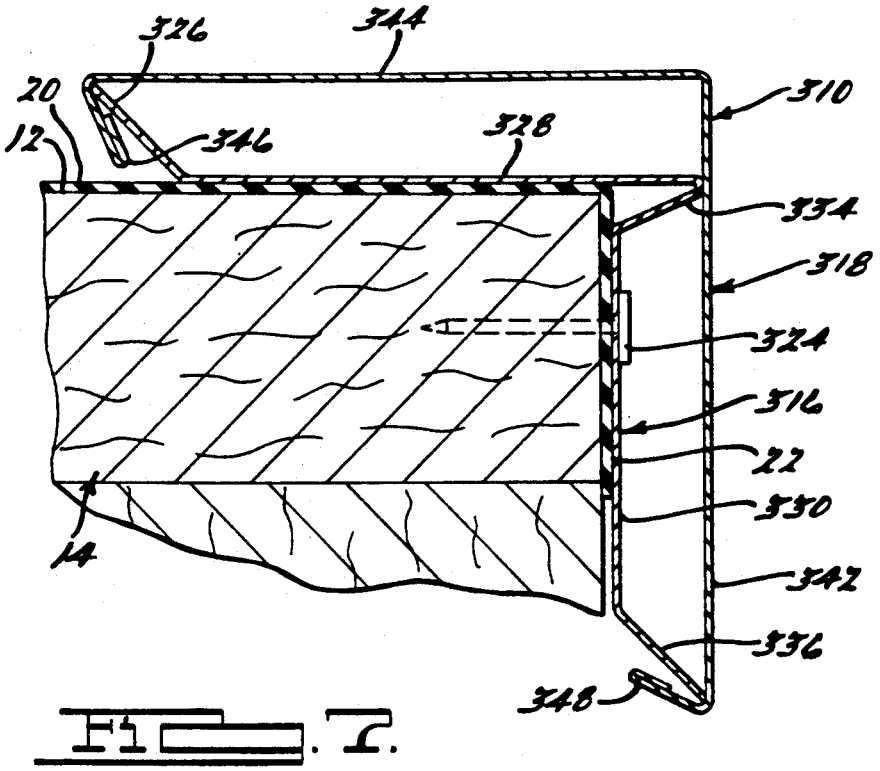
FIG. 7.
FIG. 8.
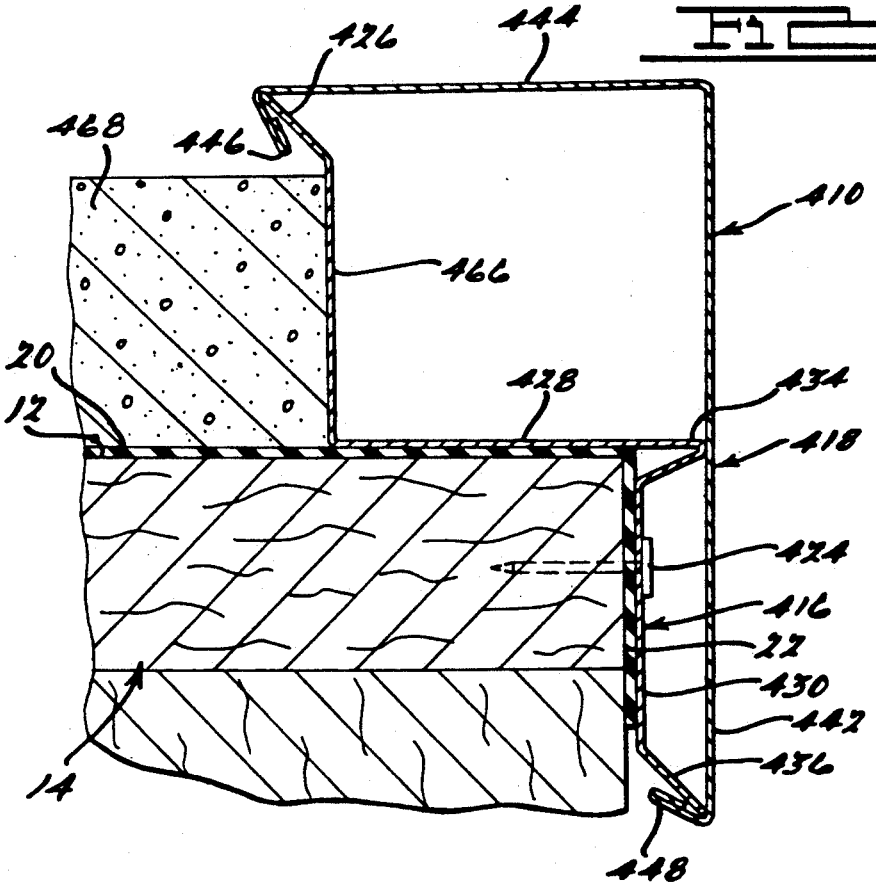

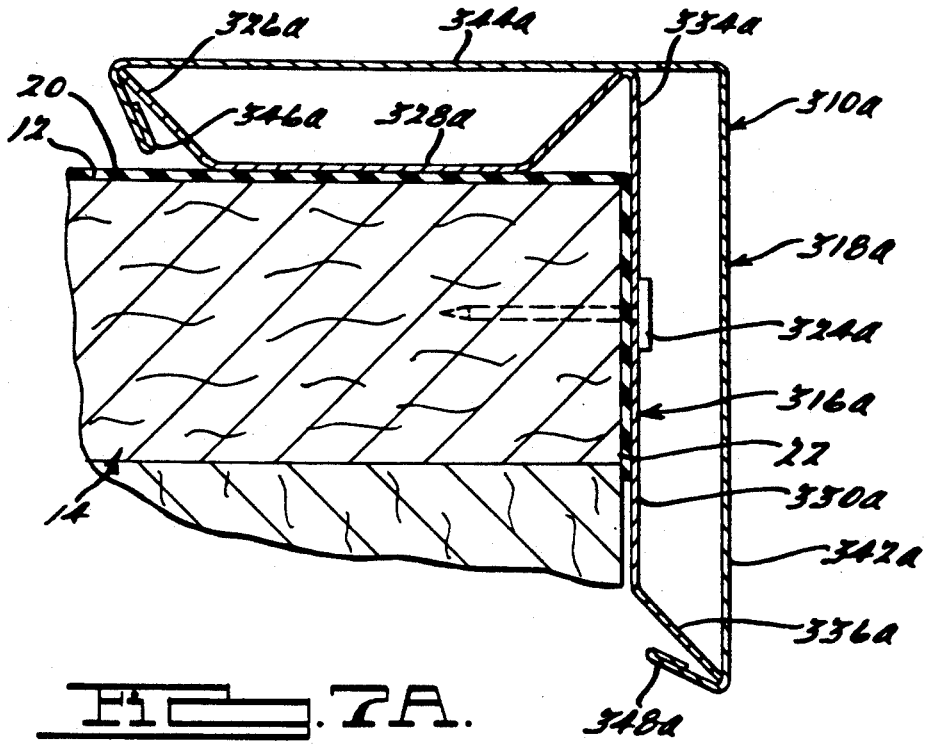
FIG. 7A.
FIG. 8A.
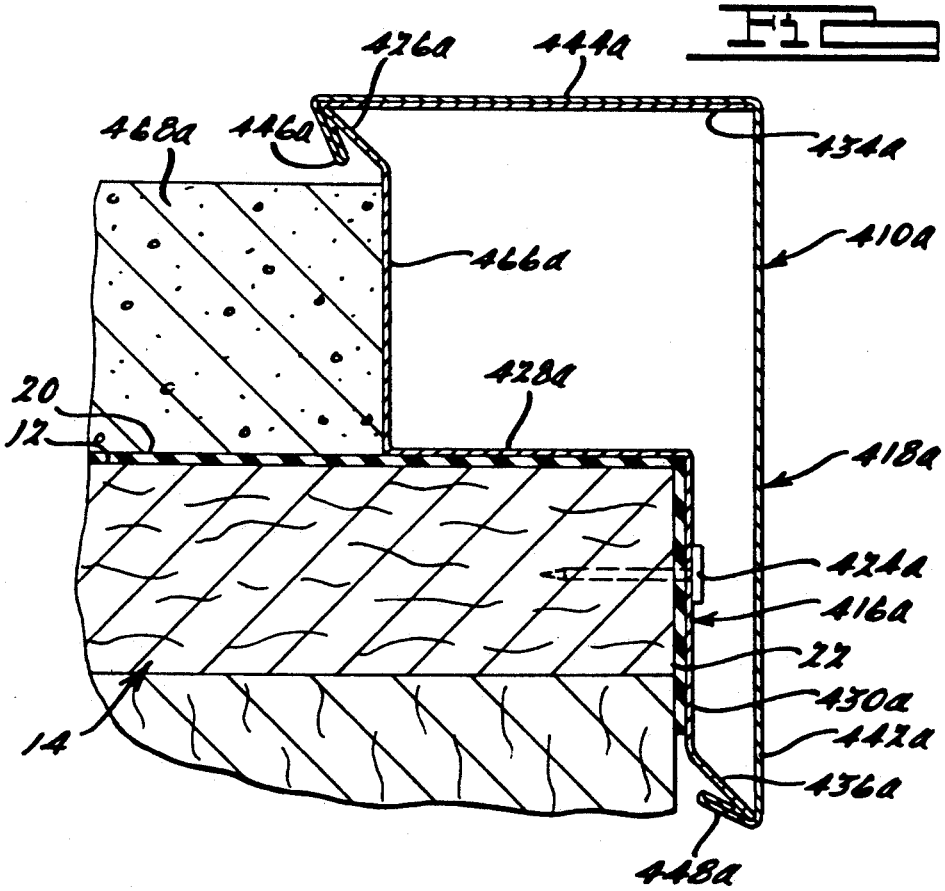

EDGE SEALING DEVICES FOR BUILDING STRUCTURES

BACKGROUND AND SUMMARY OF THE INVENTION

This is a continuation-in-part of a copending U.S. patent application, Ser. No. 532,657, filed Jun. 4, 1990, which is assigned to the same assignee as that of the present invention now abandoned.

The invention relates generally to building structures and more particularly to edge constructions for such building structures, wherein an edge sealing assembly provides a coping or seal for, or serves to sealingly anchor and clamp a sheet-like membrane or roofing material along, the edge of the building structure or along a stepped configuration formed by a facing (such as brick) adjacent a back wall, for example.

Various edge sealing constructions, copings, raised roof edge assemblies, gravel stop assemblies, water dams, and the like, have been provided for purposes of sealing upper edges of construction components, anchoring sheet-like roofing or sealing membranes, retaining gravel ballasts or other building materials, controlling water drainage, or for supporting fascia members at interfaces between various construction components, or at the edge of the roof of a building structure, for example. Examples of such previously-provided assemblies are disclosed in U.S. Pat. Nos. 3,719,010; RE 26,056; 4,071,987; 4,472,931; 4,488,384; 4,549,376; 4,586,301; 4,598,507; 4,617,770; 4,641,476; 4,662,129; 4,759,157; 4,780,999; 4,890,426; 4,909,006; and 4,964,248, as well as, the prior art references cited therein, with all of the above-mentioned patents being owned by the same assignee as the present invention. The disclosures of all of these patents are thus hereby incorporated herein by reference.

The edge sealing assemblies disclosed in the above-referenced patents represent great strides over previous edge constructions in terms of stability, simplicity, cost-effectiveness, ease of installation, flexibility of application, and effectiveness in anchoring membranes. The desire for even further improvements, however, led to the invention of the above-mentioned copending, parent application. It was found in many instances, that it is desirable to even further increase the anchoring engagement, and thus the sealing, of a roofing material at the edge of a building structure without penetrating through the roofing material, at least on the roof side of the structure, and to further increase the resistance of the roof edge assembly to wind or other uplift loads. It was also found that the use of preformed roof-covering members, frequently referred to as "roofing pavers", or "roof paving blocks", has become desirable in some applications, and thus the use of such roofing pavers has dramatically increased.

In addition, as further background to the above-mentioned copending, parent application, earlier methods of finishing the roof edges of building structures having sheet-like roofing membranes have required the use of cants, gravelstops, or other such devices to hold back ballast and roof debris. In such installations, the roofing membrane is frequently installed so as to extend over the edge device and is either clamped or bonded to it. Modern roofing membrance materials, however, are frequently adhered directly to the roof deck, and thus do not require gravel or other loose ballast to protect and hold the membrane in place. Therefore, except where the above-mentioned roofing pavers are found to be desirable or advantageous, it is frequently possible to finish the roof edge without using a gravel stop or cant, but rather to place a relatively low-profile clamping member or clamping roof edge assembly over the membrane to anchor and secure the membrane at the roof edge. Thus, the present invention seeks to provide such a roof edge assembly that is simple and relatively inexpensive to manufacture and install, that effectively seals and anchors the roofing membrane along the roof edge, and that is capable of accommodating thermal expansion and extraction of the roof edge assembly along the longitudinal edge of the building structure roof.

In accordance with these objectives, the invention of the above-mentioned copending, parent application provides an assembly for forming a roof edge on a building structure when the assembly is installed thereon, with the building structure having a generally horizontal roof surface and a generally vertical face surface, with a sheet-like roofing material or membrane extending along the horizontal roof surface and overlapping a portion of the vertical face surface. The roof edge assembly includes a relatively thin, but relatively rigid, clamping member, a portion of which has a generally L-shaped lateral cross-sectional shape defined by a generally horizontal leg portion and a generally vertical leg portion. The horizontal leg portion is adapted to engage the horizontal roof surface, and the vertical leg portion is adapted to engage the vertical face portion of the building structure, with the sheet-like roofing material clamped between the building structure and the clamping member. The horizontal leg portion includes an upper edge portion configured so as to be spaced generally away from the horizontal roof surface, and similarly the vertical leg portion includes a lower edge portion configured so as to be spaced generally away from the vertical face of the roof.

The clamping member further includes a discontinuity protruding generally away from the building structure adapted for engaging a portion of a resilient fascia member and resiliently biasing the fascia member in a direction generally outwardly when the fascia member is secured to the clamping member. Such outward resilient biasing tends to urge hooked fascia portions into a relatively tight engagement with the corresponding, respective upper and lower edge portions of the clamping member.

In some embodiments of the invention of the above-mentioned copending, parent application, the outwardly-protruding discontinuity is formed in a generally V-shaped configuration, with the apex of the V-shaped discontinuity adapted for engaging a portion of the resilient fascia member. The V-shaped discontinuity can be located generally adjacent the intersection of the vertical and horizontal leg portions of the clamping member, thus also limiting the inward position of the fascia member and correspondingly maintaining the fascia member in a properly aligned, rattle-free disposition. In some embodiments wherein the above-mentioned roofing pavers are deemed to be desirable or advantageous, the clamping member also includes a generally upwardly-extending portion disposed between the horizontal leg portion and the upper edge portion, thus forming a higher-profile, raised roof edge configuration adapted to engage roof paving blocks along the edge of the roof when installed on the building structure. In any of the embodiments, the preferred clamping member is adapted to be disposed in an overlapping relationship between adjacent clamping member portions at the joints therebetween.

In addition, it is preferred that at least the above-mentioned clamping member be composed of galvanized steel, which has a lower coefficient of expansion than some other materials, such as aluminum, for example. Such lower coefficient of expansion results in less stress on, and consequent possible damage to, the roofing material and the caulking or gasket material, if any is used, between the clamping member and the roofing material.

As background more specific to the present invention, it is common in building construction to have a facing of masonry or other materials formed along a back, either generally flush against the back wall or slightly spaced from it. In order to prevent the seepage entry of water or other elements into masonry joints or into the space or joint between the facing and the back wall, the assignee of the present invention had provided an edge sealing or coping assembly known as "Brick Cap". Such product included a generally L-shaped clip overlying portions of the upper and outer surfaces of the facing and attached thereto. Such product also included a cap-like coping or fascia attached to the back wall and sloping downwardly and outwardly over the clip on the facing, with the clip restraining the outer and lower edge of the fascia, which preferably includes an outwardly and downwardly sloping drip edge. An example of this Brick Cap product is illustrated in the drawings in FIG. 14.

Although such previous Brick Cap coping products have performed well in terms of economy, ease of installation, and the provision of an adequate seal, construction situations are frequently encountered wherein either or both of the thickness of the facing, or the spacing between the facing and the back wall, vary rather substantially along the building perimeter. This results in the depth of the Brick Cap coping or fascia being too large in some areas of the building perimeter and too small in others. Thus the need has arisen for an edge sealing or cap assembly that can accommodate such varying dimensions, that is applicable in a wide variety of applications, that is durable and effective in sealing or capping such facing-and-back wall interfaces, and that is economical and convenient to manufacture and install. Such objectives are accomplished in the present invention, which in many instances carries forward some of the principles of the invention of the above-mentioned copending, parent application.

According to the present invention, a variable-depth, or adjustable-depth, edge sealing or coping assembly is provided for sealingly covering or capping the interface between a facing construction and an adjacent back wall, with the edge sealing assembly being capable of accommodating variations in the depth of the facing and/or in the spacing from the back wall along the building perimeter. In addition, such edge sealing or coping assembly of the present invention accomplishes this function, while still maintaining a neat, aesthetic fascia appearance such that the accommodation of such varying depth dimensions is virtually undetectable from the ground.

Preferably, the edge sealing or coping assembly according to the present invention includes an underlying clip member that is attached to the facing in an overlying relationship with portions of the upper and outer surfaces of the facing, and a two-piece coping-and-facia assembly. The outer or lower fascia piece is snapped onto the underlying clip and has a downwardly and outwardly sloping top portion. The inner or upper coping piece is secured to the back wall with a downwardly and outwardly sloping portion extending sufficiently to overlap the sloping top portion of the fascia piece such that water will run down the coping piece, down the sloping top of the fascia piece, and away from the building, thus preventing entry into the facing masonry joints or the space between the facing and the back wall. In addition, such overlap between the coping member and the fascia member is sufficient to accommodate the above-mentioned variations in the dimension between the vertical outer surface of the back wall and the vertical outer surface of the facing. A preferably flexible adhesive seal is provided between the sloping portions of the coping piece and the fascia piece for purposes of sealing therebetween, substantially preventing vertical separation thereof, and for allowing relative movement therebetween caused by normal thermal expansion and contraction.

Additional objects, advantages, and features of the present invention will become apparent from the following description and appended claims, taken in conjunction with the accompanying drawings.

BRIEF DESCRIPTION OF THE DRAWINGS

FIG. 1 is a partial perspective view, shown partially in cross-section, of one of the preferred embodiments of a roof edge assembly.

FIG. 2 is an elevational view of the roof edge assembly of FIG. 1, but illustrating a portion of the fascia broken away to show the overlapping, end-to-end relationship between adjacent clamping member components.

FIG. 7 is a cross-sectional view of an alternate embodiment of the present invention, representing a variation on that of FIG. 1.

FIG. 7A is a cross-sectional view of an embodiment similar to that shown in FIG. 7, but illustrating a variation on the clamping member of the roof edge assembly.

FIG. 8 is a cross-sectional view similar to that of FIG. 7, but illustrating still another alternate embodiment of the present invention, wherein the roof edge assembly is adapted for engaging a number of roofing pavers along the edge of the roof of a building structure.

FIG. 8A is a cross-sectional view of an embodiment similar to that shown in FIG. 8, but illustrating a variation on the clamping member of the roof edge assembly.

DETAILED DESCRIPTION OF THE PREFERRED EMBODIMENTS

Figure 14:
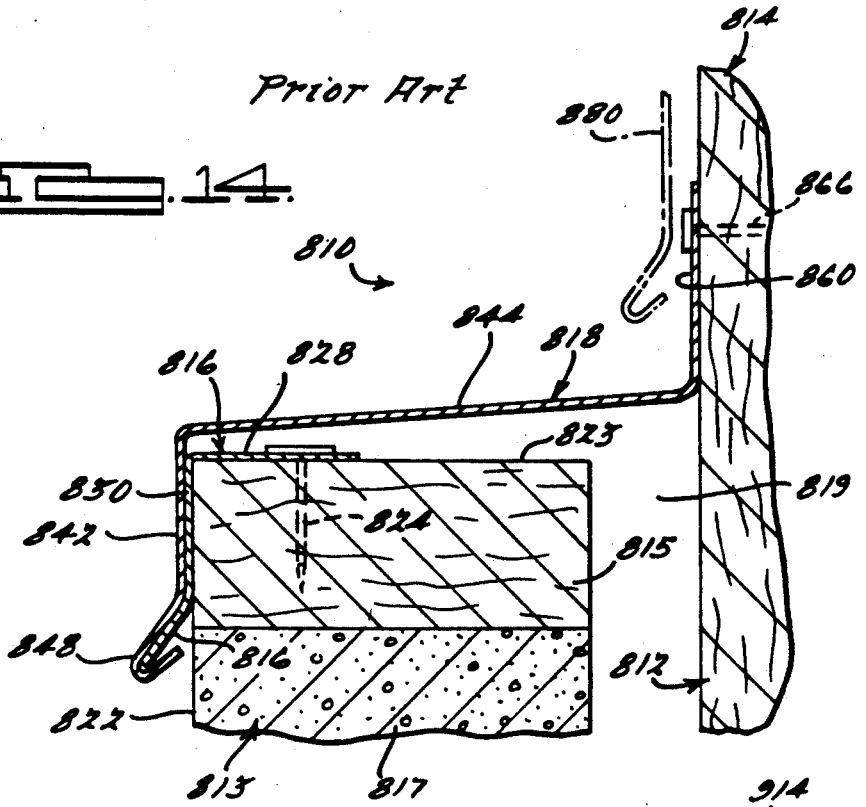
Prior Art FIG. 14.
FIG. 14 is a cross-sectional view, similar to the cross-sectional views described above, but illustrating an exemplary prior art edge sealing or coping assembly, over which the present invention represents an improvement.
Figure 15:
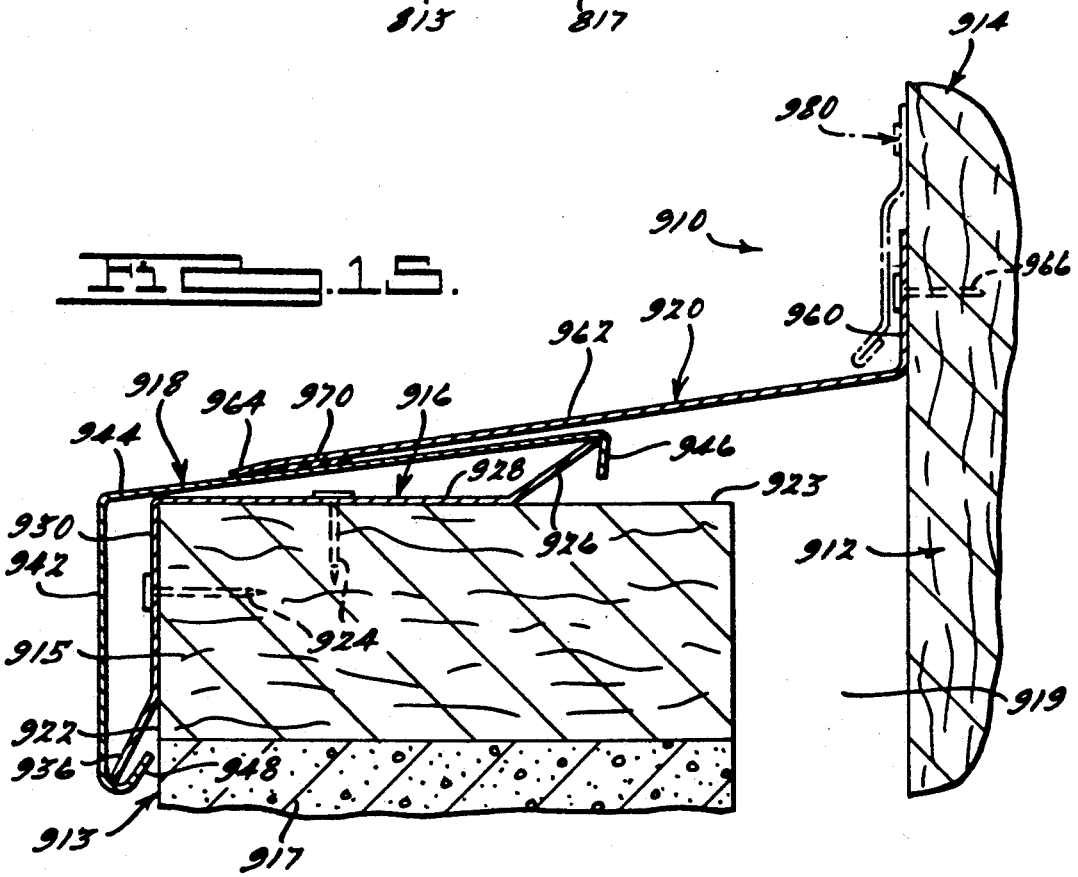
FIG. 15 is a cross-sectional view, similar to that of FIG. 14, but illustrating one of the preferred, exemplary embodiments of an edge sealing or coping assembly according to the present invention.
Figure 16:
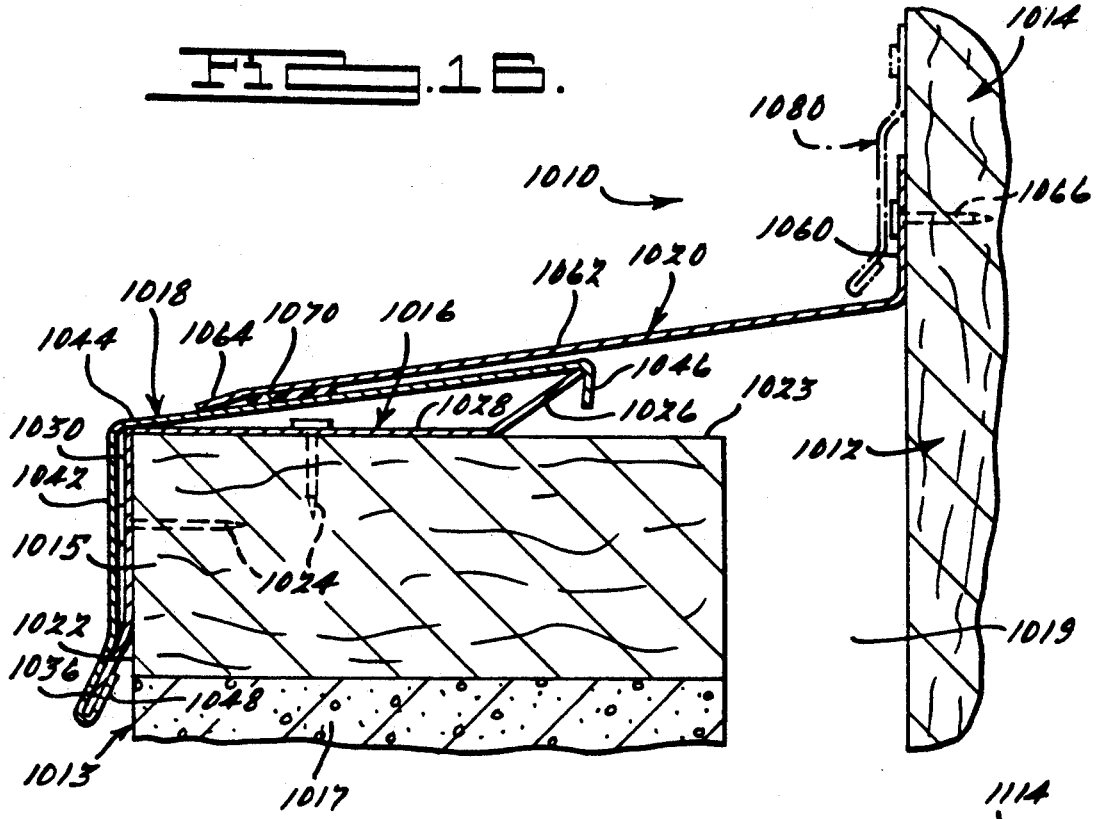
FIG. 16 is a cross-sectional view, similar to that of FIG. 15, but illustrating another embodiment of the present invention.
Figure 17:
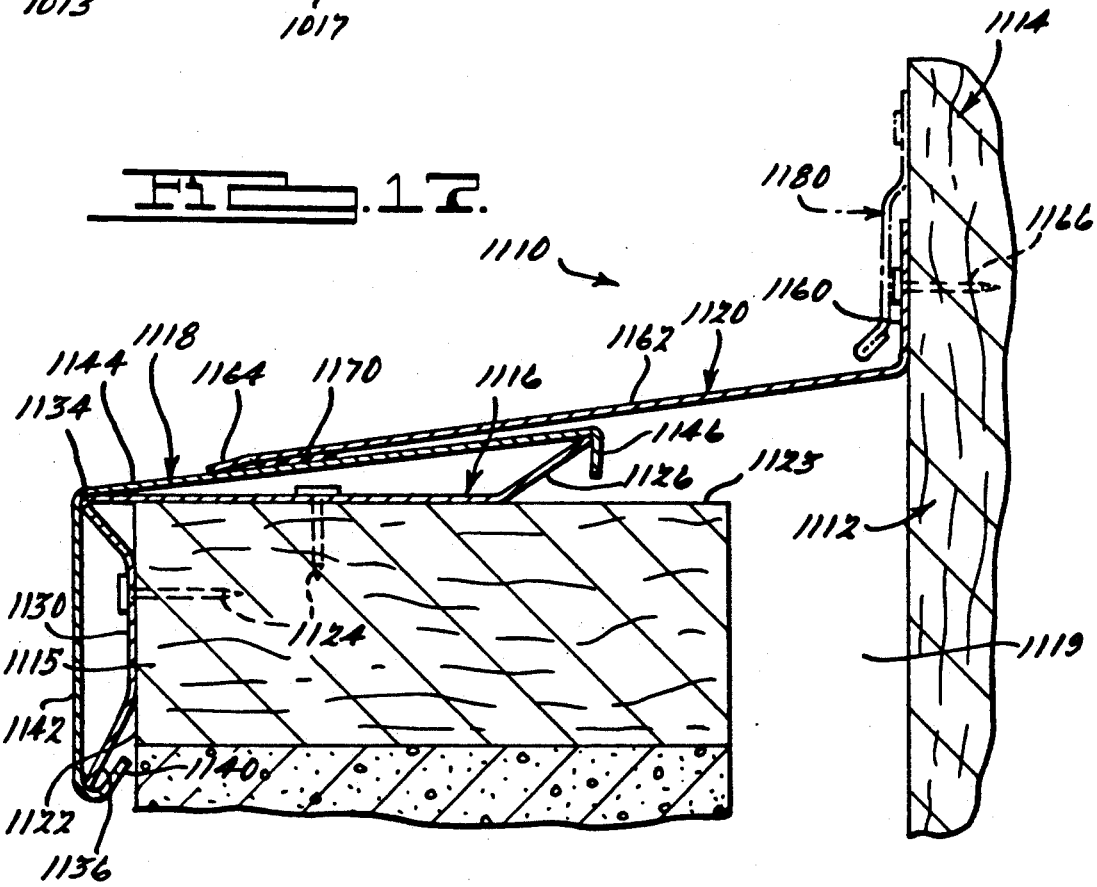
FIG. 17 is a cross-sectional view, similar to those of FIGS. 15 and 16, but illustrating still another embodiment of the present invention.

FIGS. 1 through 13 illustrate various exemplary embodiments of an assembly for forming a roof edge on a building structure in accordance with the invention of the above-mentioned copending, parent application. Similarly, FIGS. 15 through 17 illustrate various exemplary embodiments of an edge sealing or coping assembly according to the present invention, with FIG. 14 illustrating prior art therefor. It should be noted, however, that such invention is applicable in building construction configurations other than those shown for purposes of illustration in the drawings, as well as in other applications for sealing or capping building edge constructions.

In FIGS. 1 and 2, a preferred roof edge assembly 10 for forming a roof edge on a horizontal roof surface 12 of a building structure 14 generally includes a clamping member 16 and a fascia member 18 assembled for sealingly anchoring a sheet-like roofing material 20 extending along the horizontal roof surface 12 and overlapping the vertical face 22 of the building structure 14. With the roof edge assembly 10, no fasteners, and therefore no penetrations, are necessary along the horizontal roof surface 12, thus eliminating the possibility of leaks in the sheet-like roofing material 20 resulting from such penetrations. Rather, the clamping member 16 is merely attached to the vertical face 22 of the building structure 14 by way of fasteners 24, which can be threaded fasteners, nails, or other suitable fasteners known to those skilled in the art.

The clamping member 16 has an inverted, generally L-shaped cross-sectional configuration, which is defined by a generally horizontal leg portion 28 and a generally vertical leg portion 30. The horizontal leg portion 28 includes an upper edge portion 26, an similarly, the vertical leg portion 30 includes a lower edge portion 36, with such upper and lower edge portions being employed for retaining the fascia member 18 in a snapped-on relationship therewith, as is discussed in more detail below.

In a preferred form, a laterally outwardly-protruding discontinuity 34 is formed preferably in the vertical leg portion 30, and can be of a generally V-shaped, formed configuration, with the apex of the V-shaped discontinuity 34 engaging a generally vertical lower portion 42 of the fascia member 18. The fascia member 18 also includes a generally horizontally-extending upper portion 44, having a hooked upper edge portion 46 thereon, with a similar hooked lower edge portion 48 being disposed at the lower end of the generally vertical lower portion 42.

Thus, when the clamping member 16 is fixedly secured to the building structure 14, by way of the fasteners 24 securing the vertical leg portion 30 to the vertical face 22, the fascia member 18, which is preferably formed of a relatively resilient material, can be installed on the clamping member 16 by hooking the hooked lower edge 48 of the fascia member 18 onto the lower edge portion 36 of the clamping member 16, and then snapping the hooked upper edge portion 46 of the fascia member 18 over the upper edge portion 26 of the clamping member 16. When so installed, the discontinuity 34, which is preferably located generally at the intersection of the horizontal leg portion 28 and the vertical leg portion 30, engages the generally vertical lower portion 42 of the fascia member 18 in order to cause the resilient fascia member 18 to be securely retained by the clamping member 16 in a snug, rattle-free relationship therewith. In addition, the discontinuity 34 limits or restricts the inward motion of the resilient fascia member 18, both during and after installation, in order to maintain the fascia member 18 in a properly aligned, generally vertical orientation. Also, because the roofing material 20 extends along a portion of the vertical face 22, and no penetrations are made through the roofing material 20, at least along the horizontal roof surface 12, and because the roofing material 20 is securely clamped along the edges of both the horizontal roof surface 12 and the vertical face 22, the roof edge assembly 10 sealingly clamps and anchors the roofing material 20 along the roof edge of the building structure 14.

As is specifically shown in FIG. 2, the clamping member 16, although relatively rigid, is also relatively thin such that adjacent clamping members 16 overlap one another end-to-end at the joint between their ends 40, thus further eliminating or substantially minimizing the possibility of leaks. In this regard, although not specifically shown in FIGS. 1 and 2, a generally L-shaped splicer plate can optionally be positioned between the clamping member 16 and the fascia member 18 at joints between longitudinally-adjacent fascia member components. Furthermore, if deemed desirable or necessary in a given application, an optional sealing member or sealant bead 50 can be positioned along the horizontal roof surface 12, adjacent the roof edge, and sealing compressed by the clamping member 16 when the clamping member 16 is secured to the vertical face 22. In most instances, however, it is believed that the optional sealant bead 50 need not be provided since the horizontal leg portion 28 clampingly and sealingly engages the roofing material 20 directly when the vertical leg portion 30 of the clamping member 16 is secured to the vertical face 22 of the building structure 13.

Figure 3:
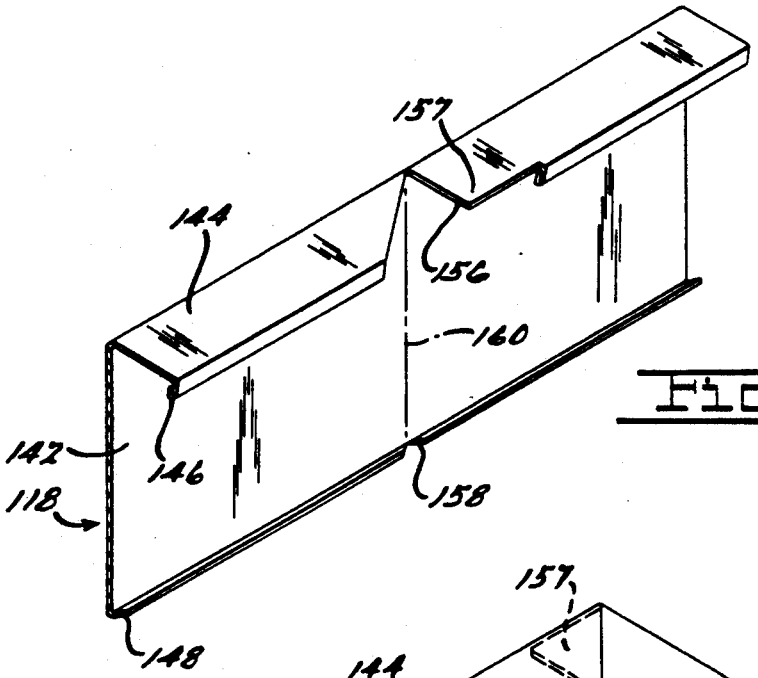
FIG. 3 illustrates a perspective view of a portion of the fascia of the roof edge assembly of FIGS. 1 and 2, adapted for forming an outside corner configuration, but illustrated prior to bending the fascia member into an angulated corner shape.
Figure 4:
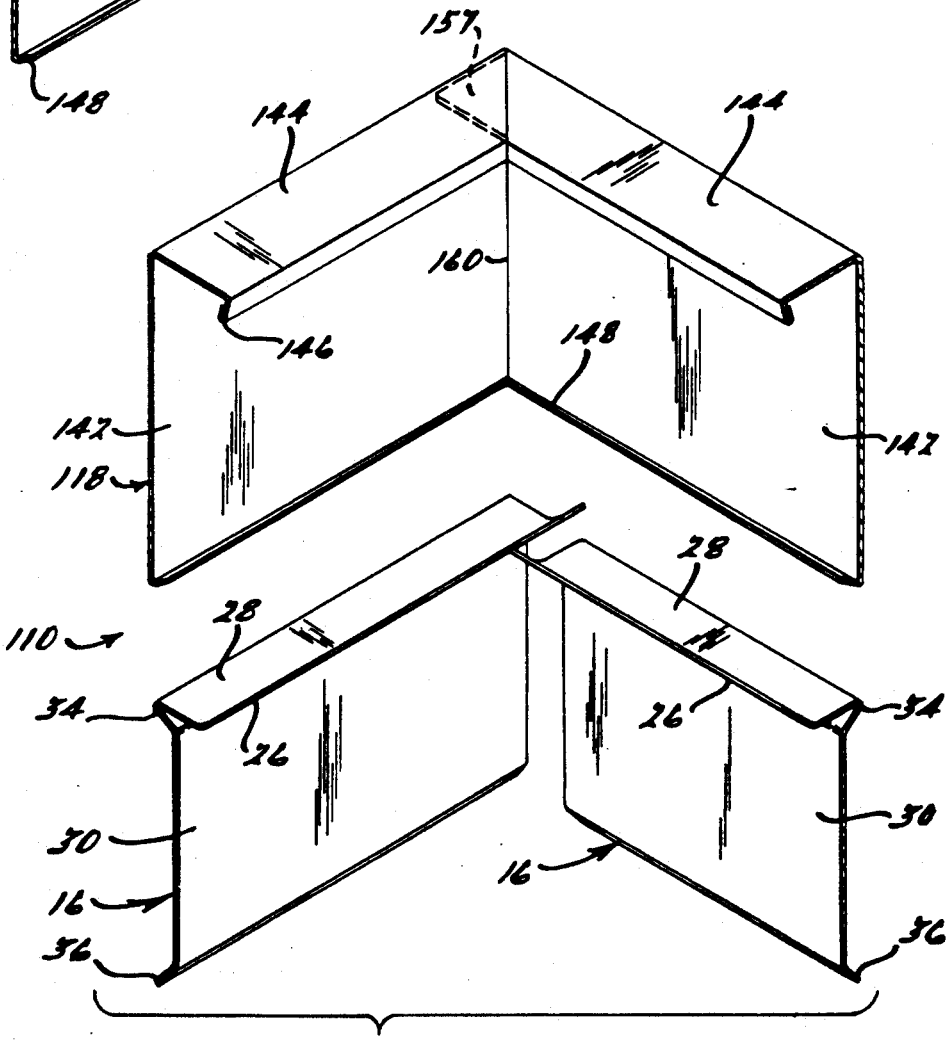
FIG. 4 illustrates the corner fascia component of FIG. 3, after being bent into an angulated corner shape, along with the adjacent clamping member arrangement for such a corner assembly.

As illustrated in FIGS. 3 and 4, the roof edge assembly components of FIGS. 1 and 2 can be modified slightly in order to form an outside corner configuration, represented in FIGS. 3 and 4 by the outside corner roof edge assembly 110. Various features and components of the outside corner roof edge assembly 110 are identical or similar, in either configuration or function, to corresponding features and components of the roof edge assembly 10 shown in FIGS. 1 and 2. Thus, such corresponding features or components are indicated by reference numerals in FIGS. 3 and 4 that are one-hundred higher than those of the corresponding features and components shown in FIGS. 1 and 2.

The outside corner roof edge assembly 110 is fabricated by cutting out a generally V-shaped cut-out portion 156 in the upper portion 144 of the fascia member 118. Similarly, a generally V-shaped cut-out portion 158 is formed in the hooked lower edge portion 148 of the fascia 118, with the cut-out portion 156 and the cut-out portion 158 being interconnected by a bend line 160 represented by a phantom line in FIG. 3. In addition, a portion of the hooked upper edge portion 146 of the fascia member 18 is cut away adjacent the cut-out portion 156, along a length generally equal to the width of the upper portion 144. This forms a tab 157 which, as is illustrated in FIG. 4, is positioned under the adjacent upper portion 144 when the fascia member 118 is bent into an angulated configuration along the bend line 160. Once formed into the outside corner configuration shown in FIG. 4, the fascia member can be snapped onto adjacent clamping member components 16, which are previously installed on the building structure in an outside-corner angulated configuration.

Figure 5:
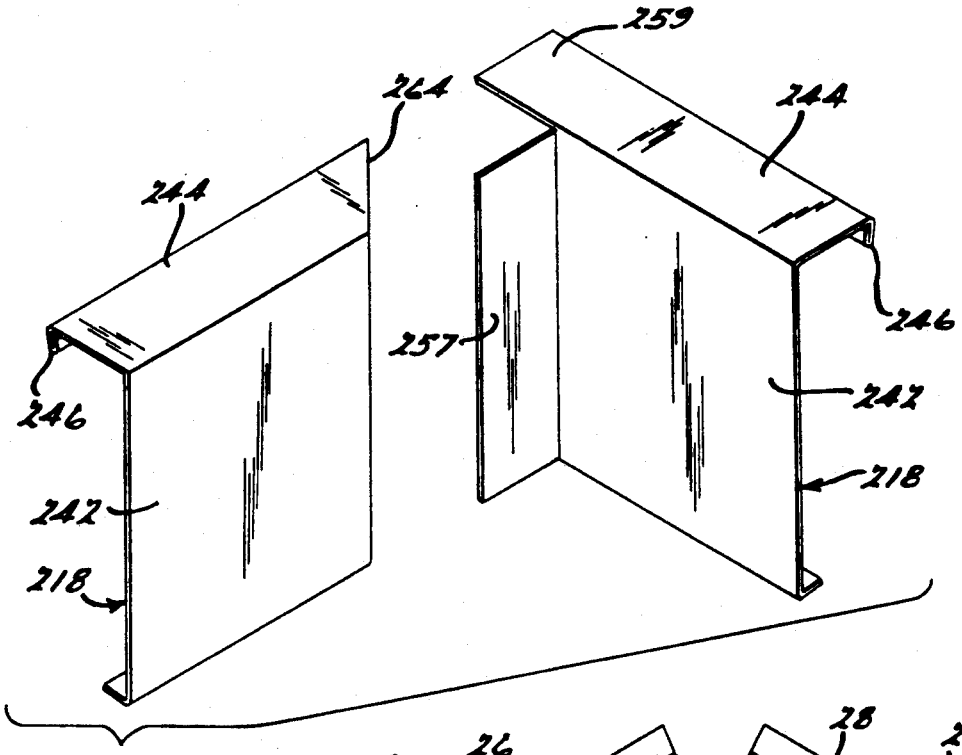
FIG. 5 illustrates a corner assembly similar to that of FIG. 3, but adapted for an inside corner application.
Figure 6:
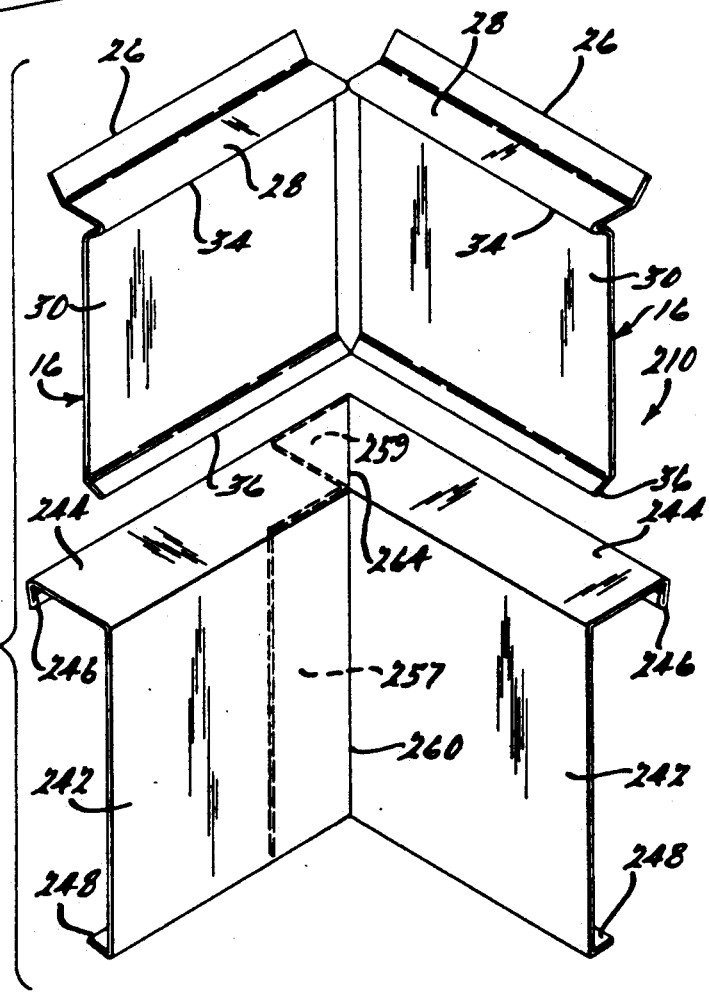
FIG. 6 is a view similar to that of FIG. 4, but illustrating the inside fascia corner arrangement of FIG. 5 assembled and ready for installation on a pair of clamping member components.

In a manner generally similar to that illustrated in FIGS. 3 and 4, an inside corner roof edge assembly 210 can be fabricated from the components of FIGS. 1 and 3, and such an arrangement is illustrated in FIGS. 5 and 6. The features and components of the inside corner roof edge assembly 210 in FIGS. 5 and 6 are identical or similar in configuration or function to corresponding elements of the roof edge assemblies shown in FIGS. 1 through 4, and thus such corresponding elements are indicated by reference numerals similar to those of FIGS. 1 through 4, but having two-hundred prefixes.

To form such an inside corner roof edge assembly 210, the fascia member 218 is cut such that a mitered edge 264 is formed on the upper portion 244. Another fascia component 218 is cut generally along the intersection of the lower portion 242 and the upper portion 244, with the cut portion of the lower portion 242 being bent outwardly, resulting in a generally vertical tab portion 257 and a generally horizontal tab portion 259, which are illustrated in the exploded illustration of FIG. 5. When the adjacent fascia components are joined together, the vertical tab portion 257 underlaps the vertical lower portion 242 of the adjacent fascia component, and the generally horizontal tab portion 259 underlaps the horizontal upper portion 244 in a similar manner. Once joined together as shown in FIG. 6, the joint between the adjacent inside corner components can optionally be welded or otherwise sealingly connected along the joint line 260 and the mitered edge 264. The assembled inside corner is then snapped onto adjacent clamping member 16, which have been secured to the inside corner vertical faces of the building structure to form the inside corner configuration shown in FIG. 6.

FIG. 7 illustrates an alternate construction of a roof edge assembly 310, which is substantially similar to that of the roof edge assembly 10 shown in FIGS. 1 and 2, and thus corresponding or similar elements are indicated by similar reference numerals, but with three-hundred prefixes in FIG. 7. The major difference between the roof edge assembly 310 of FIG. 7 and the roof edge assembly 10 of FIGS. 1 and 2 is the fabrication of the fascia member with vertical lower portions 42 that are substantially equal in width to the horizontal upper portions 44, thus resulting in a symmetrical configuration such that the facia member 318 can be snapped onto the clamping member 316 with the upper portion 344 and he lower portion 342 being interchangeable. Such a configuration provides advantages in terms of flexibility of installation in certain applications.

As with the roof edge assembly 10 shown in FIGS. 1 and 2, the sealant bead 50 shown in FIG. 1 can optionally be included in roof edge assembly 310 of FIG. 7, or in any of the embodiments of the invention, and inside or outside corner configurations can be fabricated in the embodiment of FIG. 7, or any of the other embodiments shown herein, in a manner similar to that shown in FIGS. 3 through 6.

In FIG. 7A, a variation on the clamping member 316 is indicated by reference numeral 316*a*, and similarly other corresponding elements or components are denoted by reference numerals corresponding to those of FIG. 7, but having the suffix "a". The clamping member 316*a* differs from the clamping member 316 in FIG. 7 primarily in that the discontinuity 334*a* protrudes generally upwardly rather than generally horizontally to engage the upper portion 344*a*, rather than the lower portion 342*a*, of the fascia member 318*a*.

In FIG. 8, the roof edge assembly 410 is similar in many respects to those discussed above and illustrated in the preceding figures and thus has similar or corresponding elements indicated by similar reference numerals, but having four-hundred prefixes. The roof edge assembly 410 shown in FIG. 8 differs from the previously-discussed roof edge assemblies primarily in the provision of a generally upwardly-extending portion 466 of the clamping member disposed between the upper edge portion 426 and the horizontal leg portion 428, with a corresponding height increase being provided in the vertical lower portion 442 of the fascia member 418. Such additional height allows the roof edge assembly 410 to be adapted for providing a stop for roofing pavers 468, if such roofing pavers are deemed desirable or advantageous in a particular installation. The configuration of the roof edge assembly 410 thus is configured such that the upwardly-extending portion 466 abuts the edge of the roofing pavers 468, and acting in conjunction with the upper edge portion 426, serves to retain the roofing pavers 468 in place along the edge of the roof structure.

FIG. 8A illustrates a variation on the clamping member 416 of FIG. 8, with the clamping member 416*a* of FIG. 8A having a protrusion or discontinuity 434*a* extending generally outwardly to be resiliently deflectable generally vertically and to thus engage the upper portion 444*a*, rather than the lower portion 442*a*, of the fascia member 418*a*.

Figure 9:
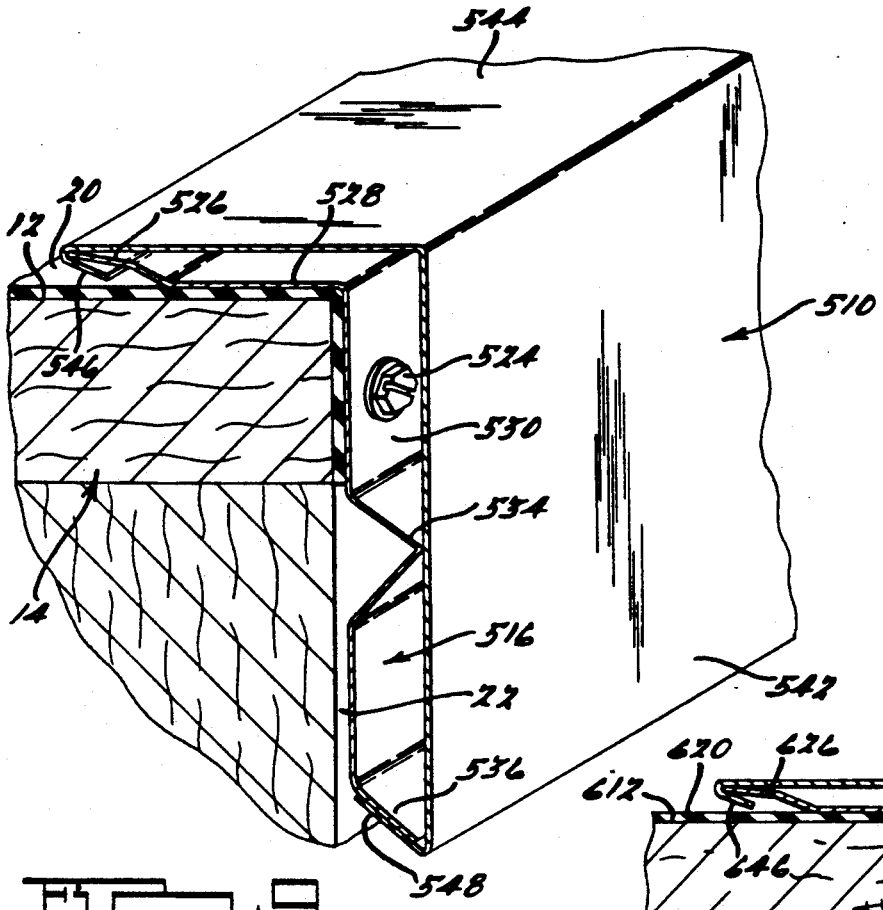
FIG. 9 is similar to FIG. 1, but illustrates still another alternate variation on the present invention.
Figure 10:
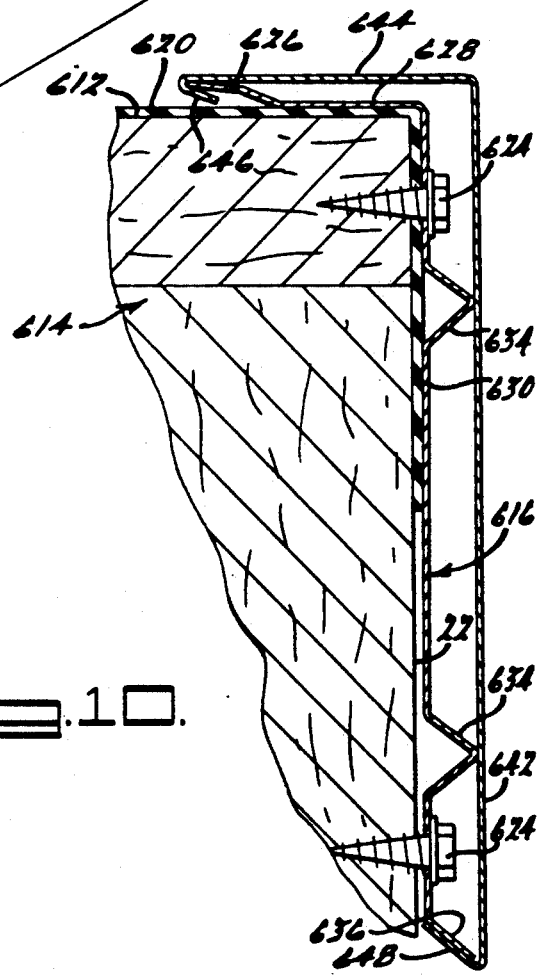
FIG. 10 is a cross-sectional view of a roof edge assembly similar to that of FIG. 9, but having a number of outwardly-protruding discontinuities on the vertical leg portion of the clamping member.

FIGS. 9 and 10 illustrate two further alternate embodiments, which are generally similar to those previously discussed, such as the roof edge assembly 10 illustrated in FIGS. 1 and 2, in particular. As with other alternate embodiments described herein, various components and features of the roof edge assemblies 510 and 610 depicted in FIGS. 9 and 10, respectively, are similar in configuration or function to corresponding components of the roof edge assembly 10 shown in FIGS. 1 and 2, and thus are indicated by similar reference numerals, but having five-hundred and six-hundred prefixes, respectively.

In FIGS. 9 and 10, the alternate roof edge assemblies 510 and 610 include one or more respective discontinuities 534 and 634 formed in the respective vertical leg portions 530 and 630 of their respective clamping members 516 and 616. In contrast to the exemplary discontinuity 34 illustrated in FIGS. 1 and 2 for the roof edge assembly 10, the discontinuities 534 or 634 are formed at an intermediate position on the respective vertical leg portions 530 and 630. Such an arrangement may prove to be beneficial or advantageous in certain roof edge assembly applications, or for alternate fascia configurations.

Figure 11:
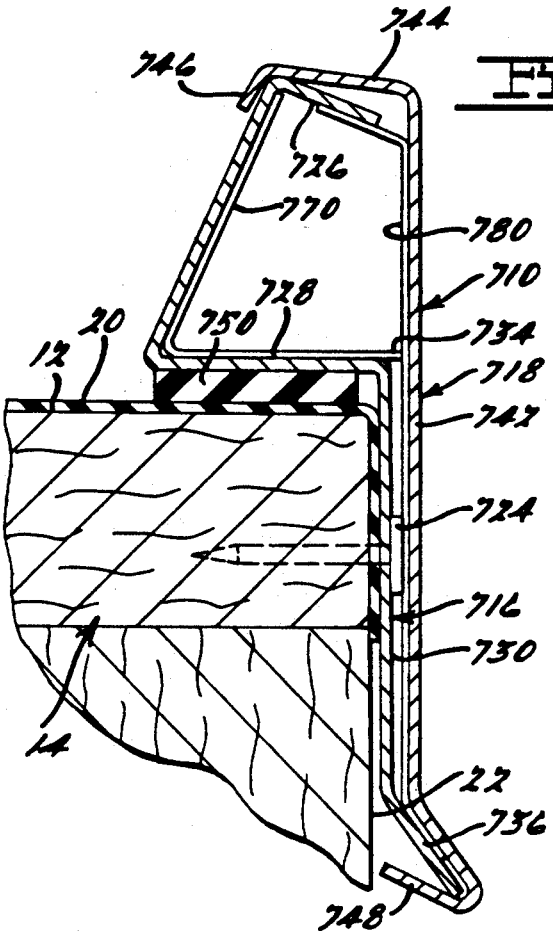
FIG. 11 illustrates a further alternate embodiment of the present invention, shown in cross-section and including splicer members at the joints between adjacent clamping member components and adjacent fascia member components.
Figure 12:
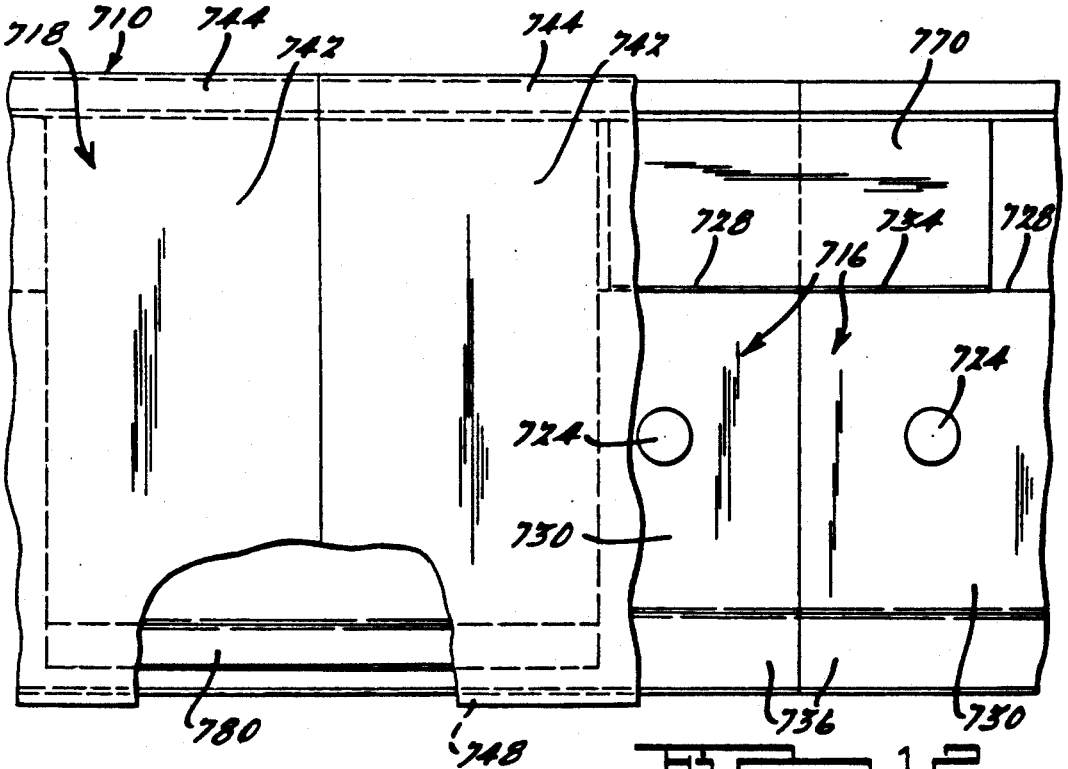
FIG. 12 is an elevational view of the roof edge assembly of FIG. 11, with portions of the fascia broken away to illustrate underlying components and splicer plates.

FIGS. 11 and 12 illustrate still a further alternate embodiment, wherein the roof edge assembly 710 includes various features or components that are generally similar, either in function or configuration, to corresponding features or components of the roof edge assembly 10 of FIGS. 1 and 2, and thus such corresponding components are indicated by reference numerals similar to those of FIGS. 1 and 2, but having seven-hundred prefixes.

The roof edge assembly 710, besides having an alternate cross-sectional configuration, preferably includes a splicer member 770 for overlaying joints between adjacent, jointed clamping members 716, and is used in this alternate construction whether the adjacent clamping members 716 are disposed in an abutting end-to-end relationship, as shown in FIG. 12, or in an overlapping end-to-end relationship similar to that described above and shown in FIG. 2 for the roof edge assembly 10. The splicer member 770 provides even further protection against moisture leakage or seepage between adjoining, adjacent clamping member 716, and further includes an end or edge portion 734 that functions in a manner similar to the discontinuity 34 of the roof edge assembly 10, in that it limits the inward position of the fascia member 718, thereby maintaining the fascia member 718 in a properly oriented and aligned disposition.

The end or edge portion 734 of the splicer member 770 can either abut the inside surface of the fascia member 718 directly, or can abut a fascia splicer member 780, which is provided in the exemplary illustration shown in FIGS. 11 and 12. Such fascia splicer member 780 is included to provide even further assurance against moisture leakage or seepage between abutting, or overlapping, adjacent fascia members 718.

In addition, in the alternate roof edge assembly 710 of FIGS. 11 and 12, the fascia member 18 includes a hooked upper edge 746 that is formed at a relatively larger angle with respect to the upper portion 744 of the fascia member 718 than is the hooked upper edge 46 of the fascia member 18 in the roof edge assembly 10 shown in FIGS. 1 and 2. Such an alternate arrangement provides for greater flexibility and ease of installation of the fascia member 718 when snapped onto the clamping member 716 during on-site assembly.

Figure 13:
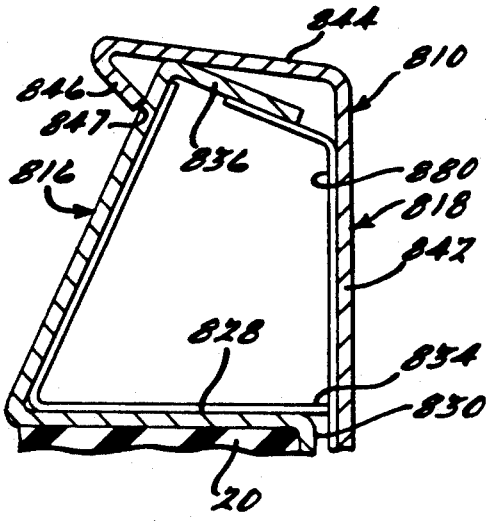
FIG. 13 is a partial cross-sectional view, similar to that of FIG. 11, but illustrating an alternate configuration of the fascia member.

FIG. 13 illustrates still another alternate construction of a roof edge assembly, wherein the roof edge assembly 810 is quite similar to the roof edge assembly 710 shown in FIGS. 11 and 12, and thus has similar or corresponding components indicated by reference numerals similar to those of FIGS. 11 and 12, but having eight-hundred prefixes. The primary difference between the roof edge assembly 810 of FIG. 13 and the roof edge 710 of FIGS. 11 and 12 is the fact that the hooked upper edge portion 846 of the fascia member 818 is formed at a generally acute angle with respect to the upper portion 844, with the edge 847 of the hooked upper edge portion 846 engaging the generally outwardly and upwardly sloped portion 832 of the clamping member 816. This arrangement, like that shown for purposes of illustration in FIGS. 11 and 12, provides for greater ease of fascia installation in certain roof edge assembly applications.

FIG. 14 illustrates a prior art edge sealing or coping assembly, exemplifying the above-mentioned Brick Cap coping product, over which the present invention represents a further improvement. The edge sealing and coping assembly 810 in FIG. 14 is adapted for sealing and capping a portion of a building structure 814 having a back wall 812 and a facing structure 813 (typically, brick) extending along all or a portion of the back wall 812 in a generally face-to-face relationship, with the facing 813 typically spaced somewhat from the back wall 612. Conventionally, a wooden nailer strip 815 is secured to the top of a brick masonry structure 817, or other such facing structure, in order to form a facing assembly 813. The facing assembly 813 includes a vertical outer face surface 822 and a generally horizontal upper face surface 823.

The assembly 810 generally includes a clip member 816, a fascia member 818, and a coping member 820. The clip member 816 in turn generally includes a generally horizontal leg portion 828 and a generally vertical leg portion 830, with the vertical leg portion 830 preferably having a lower edge portion 836 spaced away from the vertical outer surface 822 of the facing assembly 813 with the lower edge portion 836 typically sloping outwardly and downwardly.

The combination fascia and coping member 818 includes an upper portion 860 secured to the back wall 812, a generally downwardly and outwardly sloping upper portion 844, and a generally vertically-extending lower portion 842, with a hooked lower edge portion 848 thereon for interlockingly engaging the lower edge portion 836 of the clip member 816 prior to securing the upper portion 860 to the back wall 812. If necessary in a given installation, a separate or additional fascia-like assembly 880 can optionally be provided in order to cause water or other elements to drip away from the attachment of the upper portion 860 to the back wall 812.

As is discussed above, the edge sealing and coping assembly 810 depicted in FIG. 14 has performed very well for sealing and capping the interface between a back wall and an outer facing structure. However, in many installations, the horizontal depth of the facing 813 and/or the spacing between the facing 813 and the back wall 812 can vary rather substantially throughout the perimeter of a building structure. In such cases, the edge sealing and coping assembly 810 can suffer from the disadvantage of having a horizontal depth that is too large in some areas of the perimeter of a given building structure and too small in other areas of the perimeter of the same building structure. Accordingly, the present invention, examples of which are depicted in FIGS. 15 through 17, seeks to provide the same excellent performance as the assembly 810 of FIG. 14, but also including a provision for accommodating such variations in the horizontal dimension between the outer vertical surface of the back wall and the outer vertical surface of the facing wall or structure.

In FIG. 15, one of the preferred, exemplary embodiments of the present invention is depicted. An edge sealing or coping assembly 910 according to the present invention generally includes a clip member 916, a fascia member 918, and a separate coping member 920. The clip member 916 includes a generally horizontal leg portion 928 and a generally vertical leg portion 930, forming a generally L-shaped lateral cross-sectional configuration. The horizontal leg portion 928 includes a preferably upwardly and inwardly sloping upper edge portion 926, and similarly, the vertical leg portion 930 includes a preferably downwardly and outwardly sloping lower edge portion 936.

The clip member 916 is preferably attached directly to the wooden nailer strip 915, which is in turn secured to the upper edge of the brick masonry 917 or other such material by way of J-bolts, anchors, or other suitable means known to those skilled in the art in order to make up the facing structure 913. Such preferred direct attachment of the clip member 916 to the facing 913 can be by way of one or more fasteners 924, or can alternately be accomplished by other fastening means well-known to those skilled in the art and suitable for building construction.

The fascia member 918 has a generally angulated lateral cross-sectional configuration, with a lower portion 942 extending generally vertically along the vertical leg portion 930 of the clip member 916, and with a generally outwardly and downwardly sloping upper portion 944 extending above the horizontal leg portion 928 of the clip member 916. The sloping upper portion 944 of the fascia member 918 includes a generally hook-shaped upper edge portion 946 adapted for interlockingly engaging the upper edge portion 926 of the clip member 916, and similarlly the vertical lower portion 942 of the fascia member 918 includes a generally hook-shaped lower edge portion 948 adapted for similarly interlockingly engaging the lower edge portion 936 of the clip member 916.

The coping member 920 includes a generally vertical upper portion 960, which is secured to the outer vertical surface of the back wall 912, preferably by way of a fastener 966 or suitable means known to those skilled in the art, with a downwardly and outwardly sloping lower portion 962 of the coping member 920 overlapping the sloping upper portion 944 of the fascia member 918. Such overlapping relationship of the sloping lower portion 962 of the coping member 920 with the sloping upper portion 944 of the fascia member 918 is sufficient to cause water or other elements to run downwardly and outwardly away from the back wall 912, and then to run downwardly and outwardly along the sloping upper fascia portion 944, and thus to run away from the building. Such water or other elements are thus prevented from contact with the horizontal upper surface 923 of the facing 913 and from the space 919 (if any) between the facing 913 and the back wall 912. In addition, such overlapping relationship is sufficient, along with the horizontal depth of the sloping upper fascia portion 944, to accommodate rather substantial variations in the horizontal depth of the facing 913, and/or in the horizontal dimension of the space 919. Thus variations along the perimeter of the building structure 914 between the vertical outer surface of the back wall 912 and the vertical outer surface 922 of the facing 913 can be easily and conveniently accommodated.

Preferably, the coping member 920 has a sloping lower edge portion 964 that slopes downwardly and outwardly at a larger angle relative to a horizontal line than does the sloping lower portion 962. Such an arrangement allows sufficient space for a sealing bead or member 970 to be sealingly disposed between the sloping lower coping portion 962 and the sloping upper fascia portion 944. In addition, the configuration wherein the sloping lower edge portion 964 is provided on the sloping lower coping portion 962 provides for a more positive, downwardly biased engagement of the sloping lower coping portion 962 with the sloping upper fascia portion 944, thus assuring a substantially tight, rattle-free assembly.

Preferably, the sealing member 970, which can be a sealing bead applied along the sloping upper fascia portion 944, or a solid sealing member similarly adhered and applied, is sufficiently flexible to allow for relative movement between the sloping lower coping portion 962 and the sloping upper fascia portion 944, such as may result from thermal contraction or expansion. In addition, the sealing bead or member 970 preferably has an adhesive therein or thereon, such that the sloping lower coping portion 962 is adhered through the sealing bead or member 970 to the sloping upper fascia portion 944, thus substantially preventing separation therebetween, along with the above-mentioned downward biasing force of the lower coping portion 962 against the upper fascia portion 944.

In addition, as is discussed above in connection with the prior art edge or coping assembly 18 depicted in FIG. 14, an optional upper or auxiliary fascia assembly 980 can also be employed.

FIG. 16 illustrates an alternate variation on the present invention, wherein an edge sealing or coping assembly 1010 is substantially identical with the assembly 910 illustrated in FIG. 15, with certain exceptions noted below. Because of such similarity between these assemblies, components of FIG. 16 that are similar or identical to those of FIG. 15 are indicated by like reference numerals, but with the reference numerals of FIG. 16 having one-thousand prefixes rather than the nine-hundred prefixes of FIG. 15.

The edge sealing or coping assembly 1010 of FIG. 16 varies from the corresponding assembly of FIG. 15 in that the vertical lower portion 1042 of the fascia member 1018 is adapted to more closely extend along the vertical leg portion 1030 of the clip member 1016, with the lower edge portion 1036 of the clip member 1016 being received in a correspondingly downwardly and outwardly sloping hooked lower edge portion 1048 on the lower edge of the vertical lower fascia portion 1042. In all other respects, however, the assembly 1010 of FIG. 16 is substantially identical in configuration and function as the coping assembly 910 of FIG. 15.

FIG. 17 illustrates still another optional variation on the present invention, wherein the edge sealing or coping assembly 1110 is substantially identical in configuration and function with the edge sealing or coping assembly 910 of FIG. 15, with certain exceptions noted below. Accordingly, similar or corresponding components in FIGS. 17 and 15 are also indicated by like reference numerals, with the reference numerals of FIG. 17 having eleven-hundred prefixes rather than the nine-hundred prefixes of FIG. 15.

The coping assembly 1110 of FIG. 17 differs from the coping assembly 910 of FIG. 15, in that the vertical leg portion 1130 of the clip member 1116 includes a generally horizontally outwardly-protruding protrusion or discontinuity 1134 preferably formed therein. The protrusion 1134 can be of a generally V-shaped, formed configuration, with the apex of the V-shaped protrusion 1134 engaging the vertical lower fascia portion 1142. The protrusion 1134, which is preferably located generally at, or adjacent to, the intersection of the horizontal leg portion 1128 and the vertical leg portion 1130 of the clip member 1116, engages the generally vertical lower fascia portion 1142. This causes the fascia member 1118 to be resiliently biased outwardly and securely retained by the clip member 1116 in a snug-rattle-free relationhship therewith due to the resiliently and tightly held engagement of the hooked upper fascia edge portion 1146 with the upper edge portion 1126 of the clip member 1116 and the similar engagement of the hooked lower fascia edge portion 1148 with the lower edge portion 1136 of the clip member 1116. In all other respects, however, the edge sealing or coping assembly 1110 of FIG. 17 is substantially identical in function and configuration with the edge sealing or coping assembly 910 of FIG. 15. In this regard, one skilled in the art will readily recognize that the outwardly and downwardly sloping arrangement of FIG. 16 can readily be combined with the alternate embodiment of FIG. 17, with such lower edge configuration having to extend outwardly and downwardly a sufficient distance to extend outwardly beyond the engagement of the protrusion 1134 with the vertical lower fascia portion 1142.

In addition, any of the embodiments of the invention depicted in the drawings and discussed herein can optionally be employed in conjunction with a leak-proof membrane, such as is commonly used as a roofing membrane, with such membrane extending from between the upper coping portion 960 in FIG. 15, downwardly and outwardly to a position between the sloping lower coping portion 962 and the sloping upper fascia portion 944, or between other components of the lower portion of the edge sealing or coping assembly, if such membrane is deemed to be desirable or advantageous in a given installation.

The foregoing discussion discloses and describes exemplary embodiments of the present invention. One skilled in the art will readily recognize from such discussion, and from the accompanying drawings and claims, that various changes, modifications, and variations can be made therein without departing from the spirit and scope of the invention as defined in the following claims.

We claim:

1. An edge sealing assembly for sealingly capping a portion of a building construction having a back wall with a vertical outer surface thereon and a facing structure with a horizontal upper surface and a vertical outer surface thereon, the facing structure being disposed adjacent to the back wall in a generally face-to-face relationship therewith, said edge sealing assembly comprising:

an elongated clip member having a generally L-shaped lateral cross-sectional configuration defined by a generally horizontal leg portion and a generally vertical leg portion, said horizontal leg portion being adapted to engage the horizontal upper surface of the facing structure and said vertical leg portion being adapted to engage the vertical surface of the facing structure, said horizontal leg portion including an upper edge portion thereon configured to be spaced generally away from the horizontal upper surface of the facing structure, said vertical leg portion including a lower edge portion thereon configured to be spaced generally away from the vertical surface of the facing structure;

fastening means for securing said clip member to the facing structure;

an elongated fascia member having a generally angulated lateral cross-sectional configuration, a lower portion of said fascia member being adapted for extending generally along said vertical leg portion of said clip member and having a generally hook-shaped lower fascia edge portion adapted for interlockingly engaging said lower edge portion of said clip member, an upper portion of said fascia member sloping downwardly and outwardly toward said lower fascia portion and being adapted for extending over said horizontal leg portion of said clip member and having a generally hook-shaped upper fascia edge portion adapted for interlockingly engaging said upper edge portion of said clip member, said fascia member being resiliently snapped onto said clip member after one of said hooked fascia edge portions is interlockingly engaged with the corresponding respective edge portion of said clip member in order to secure said fascia member thereto;

an elongated coping member having a generally angulated lateral cross-sectional configuration, an upper portion of said coping member being adapted for engaging the vertical outer surface of the back wall, and a lower portion of said coping member sloping downwardly and outwardly from said upper coping portion and being adapted to overlap said downwardly and outwardly sloping upper fascia portion in order to accommodate a variety of lateral dimensions between the vertical outer back wall surface and the vertical outer facing surface; and fastening means for securing said upper coping portion to the vertical outer surface of the back wall.

2. An assembly according to claim 1, further including sealing means sealingly disposed between said sloping lower coping portion and said sloping upper fascia portion.

3. An assembly according to claim 2, wherein said sealing means includes adhesive means for adhering said lower coping portion and said upper fascia portion to one another.

4. An assembly according to claim 3, wherein said sealing means is flexible in order to accommodate a predetermined amount of relative movement between said lower coping portion and said upper fascia portion.

5. An assembly according to claim 1, wherein the facing structure is spaced outwardly from the back wall, said spacing varying along the perimeter of the building construction, said lower coping portion overlapping said upper fascia portion sufficiently to maintain said overlapping relationship along the entire perimeter of the building structure.

6. An assembly according to claim 1, wherein said coping member has a lower edge portion thereon sloping generally downwardly and outwardly from said downwardly and outwardly sloping lower coping portion in order to engage said upper fascia portion.

7. An assembly according to claim 6, wherein said lower coping edge portion is resiliently biased against said upper fascia portion.

8. An assembly according to claim 1, wherein said vertical leg portion of said clip member has a generally outwardly-protruding protrusion thereon adapted for engaging said lower fascia portion and biasing said lower fascia portion generally outwardly when said fascia member is secured to said clip member in order to urge said hooked fascia portions into a relatively tight engagement with the corresponding respective edge portions of said clip member.

9. An assembly according to claim 8, wherein said outwardly-protruding protrusion is generally V-shaped with the apex of said V-shaped protrusion being adapted for engaging said lower fascia portion.

10. An assembly according to claim 8, wherein said outwardly-protruding protrusion is located generally adjacent the intersection of said vertical and horizontal leg portions of said clip member.

11. An edge sealing assembly for sealingly capping a portion of a building construction having a back wall with a vertical outer surface thereon and a facing structure with a horizontal upper surface and a vertical outer surface thereon, the facing structure being disposed adjacent to the back wall and spaced outwardly therefrom in a generally face-to-face relationship therewith, said edge sealing assembly comprising:

an elongated clip member having a generally L-shaped lateral cross-sectional configuration defined by a generally horizontal leg portion and a generally vertical leg portion, said horizontal leg portion being adapted to engage the horizontal upper surface of the facing structure and said vertical leg portion being adapted to engage the vertical surface of the facing structure, said horizontal leg portion including an upper edge portion thereon configured to be spaced generally away from the horizontal upper surface of the facing structure, said vertical leg portion including a lower edge portion thereon configured to be spaced generally away from the vertical surface of the facing structure;

fastening means for securing said clip member to the facing structure;

an elongated fascia member having a generally angulated lateral cross-sectional configuration, a lower portion of said fascia member being adapted for extending generally along said vertical leg portion of said clip member and having a generally hook-shaped lower fascia edge portion adapted for interlockingly engaging said lower edge portion of said clip member, an upper portion of said fascia member sloping downwardly and outwardly toward said lower fascia portion and being adapted for extending over said horizontal leg portion of said clip member and having a generally hook-shaped upper fascia edge portion adapted for interlockingly engaging said upper edge portion of said clip member, said fascia member being resiliently snapped onto said clip member after one of said hooked fascia edge portions is interlockingly engaged with the corresponding respective edge portion of said clip member in order to secure said fascia member thereto;

an elongated coping member having a generally angulated lateral cross-sectional configuration, an upper portion of said coping member being adapted for engaging the vertical outer surface of the back wall, and a lower portion of said coping member sloping downwardly and outwardly from said upper coping portion and being adapted to overlap said downwardly and outwardly sloping upper fascia portion sufficiently to accommodate a variety of lateral dimensions between the vertical outer back wall surface and the vertical outer facing surface along the entire perimeter of the building structure;

fastening means for securing said upper coping portion to the vertical outer surface of the back wall; and sealing means sealingly disposed between said sloping lower coping portion and said sloping upper fascia portion, said sealing means including adhesive means for adhering said lower coping portion and said upper fascia portion to one another, said sealing means being flexible in order to accommodate a predetermined amount of relative movement between said lower coping portion and said upper fascia portion.

12. An assembly according to claim 11, wherein said coping member has a lower edge portion thereon sloping generally downwardly and outwardly from said downwardly and outwardly sloping lower coping portion in order to engage said upper fascia portion.

13. An assembly according to claim 12, wherein said lower coping edge portion is resiliently biased against said upper fascia portion.

14. An assembly according to claim 11, wherein said vertical leg portion of said clip member has a generally outwardly-protruding protrusion thereon adapted for engaging said lower fascia portion and biasing said lower fascia portion generally outwardly when said fascia member is secured to said clip member in order to urge said hooked fascia portions into a relatively tight engagement with the corresponding respective edge portions of said clip member.

15. An assembly according to claim 14, wherein said outwardly-protruding protrusion is generally V-shaped with the apex of said V-shaped protrusion being adapted for engaging said lower fascia portion.

16. An assembly according to claim 15, wherein said outwardly-protruding protrusion is located generally adjacent the intersection of said vertical and horizontal leg portions of said clip member.

17. An edge sealing assembly for sealingly capping a portion of a building construction having a back wall with a vertical outer surface thereon and a facing structure with a horizontal upper surface and a vertical outer surface thereon, the facing structure being disposed adjacent to the back wall and spaced outwardly therefrom in a generally face-to-face relationship therewith, said edge sealing assembly comprising:

an elongated clip member having a generally L-shaped lateral cross-sectional configuration defined by a generally horizontal leg portion and a generally vertical leg portion, said horizontal leg portion being adapted to engage the horizontal upper surface of the facing structure and said vertical leg portion being adapted to engage the vertical surface of the facing structure, said horizontal leg portion including an upper edge portion thereon configured to be spaced generally away from the horizontal upper surface of the facing structure, said vertical leg portion including a lower edge portion thereon configured to be spaced generally away from the vertical surface of the facing structure, said vertical leg portion of said clip member having a generally outwardly-protruding protrusion thereon;

fastening means for securing said clip member to the facing structure;

an elongated fascia member having a generally angulated lateral cross-sectional configuration, a lower portion of said fascia member being adapted for extending generally along said vertical leg portion of said clip member and having a generally hook-shaped lower fascia edge portion adapted for interlockingly engaging said lower edge portion of said clip member, an upper portion of said fascia member sloping downwardly and outwardly toward said lower fascia portion and being adapted for extending over said horizontal leg portion of said clip member and having a generally hook-shaped upper fascia edge portion adapted for interlockingly engaging said upper edge portion of said clip member, said fascia member being resiliently snapped onto said clip member after one of said hooked fascia edge portions is interlockingly engaged with the corresponding respective edge portion of said clip member in order to secure said fascia member thereto, said lower fascia portion being engaged by said protrusion on said clip member and being biased generally outwardly by said protrusion when said fascia member is secured to said clip member in order to urge said hooked fascia portions into a relatively tight engagement with the corresponding respective edge portions of said clip member;

an elongated coping member having a generally angulated lateral cross-sectional configuration, an upper portion of said coping member being adapted for engaging the vertical outer surface of the back wall, and a lower portion of said coping member sloping downwardly and outwardly from said upper coping portion and being adapted to overlap said downwardly and outwardly sloping upper fascia portion in order to accommodate a variety of lateral dimensions between the vertical outer back wall surface and the vertical outer facing surface along the entire perimeter of the building structure;

fastening means for securing said upper coping portion to the vertical outer surface of the back wall; and sealing means sealingly disposed between said sloping lower coping portion and said sloping upper fascia portion.

18. An assembly according to claim 17, wherein said outwardly-protruding protrusion is generally V-shaped with the apex of said V-shaped protrusion being adapted for engaging said lower fascia portion.

19. An assembly according to claim 18, wherein said outwardly-protruding protrusion is located generally adjacent the intersection of said vertical and horizontal leg portions of said clip member.

20. An assembly according to claim 17, wherein said sealing means includes adhesive means for adhering said lower coping portion and said upper fascia portion to one another.

21. An assembly according to claim 20, wherein said sealing means is flexible in order to accommodate a predetermined amount of relative movement between said lower coping portion and said upper fascia portion.

22. An assembly according to claim 17, wherein said coping member has a lower edge portion thereon sloping generally downwardly and outwardly from said downwardly and outwardly sloping lower coping portion in order to engage said upper fascia portion.

23. An assembly according to claim 22, wherein said lower coping edge portion is resiliently biased against said upper fascia portion.

* * * * *

UNITED STATES PATENT AND TRADEMARK OFFICE

CERTIFICATE OF CORRECTION

PATENT NO. : 5,189,853

DATED : March 2, 1993

INVENTOR(S) : Braine, et al

It is certified that error appears in the above-identified patent and that said Letters Patent is hereby corrected as shown below:

Column 1, line 65, "membrance" should be --membrane--.

Column 8, line 10, "he" should be --the--.

Column 11, line 35, "similarlly" should be --similarly--.

Column 13, lines 10-11, "relationhship" should be --relationship--.

Signed and Sealed this

Twenty-second Day of February, 1994

*Attest:*

Bruce Lehman

BRUCE LEHMAN

*Attesting Officer*

*Commissioner of Patents and Trademarks*